United States Patent [19]

Hopper

[11] Patent Number: 5,070,944

[45] Date of Patent: Dec. 10, 1991

[54] DOWN HOLE ELECTRICALLY OPERATED SAFETY VALVE

[75] Inventor: Hans P. Hopper, Aberdeen, Scotland

[73] Assignee: British Petroleum Company p.l.c., London, England

[21] Appl. No.: 593,140

[22] Filed: Oct. 5, 1990

[30] Foreign Application Priority Data

Oct. 11, 1989 [GB] United Kingdom ..... 8922883
Jan. 27, 1990 [GB] United Kingdom ..... 9001905

[51] Int. Cl.[5] ..... E21B 34/06; F16K 31/02

[52] U.S. Cl. ..... 166/66.4; 166/332; 251/129.2; 251/129.21

[58] Field of Search ..... 166/65.1, 66.4, 66.5, 166/332; 251/129.01, 129.03, 129.11, 129.15, 129.19, 129.2, 129.21

[56] References Cited

U.S. PATENT DOCUMENTS

| | | | |
|---|---|---|---|
| 3,665,955 | 5/1972 | Conner, Sr. | 166/66.4 |
| 4,373,582 | 2/1983 | Bednar et al. | 166/66.4 |
| 4,566,534 | 1/1986 | Going, III | 166/66.4 |
| 4,948,091 | 8/1990 | Satoh et al. | 251/129.2 |

FOREIGN PATENT DOCUMENTS 2216625 10/1989 United Kingdom .

OTHER PUBLICATIONS

"The Flexible Transmission", Harmonic Drive Limited brochure.

*Primary Examiner*—Bruce M. Kisliuk
*Attorney, Agent, or Firm*—C. S. Lynch; M. F. Esposito; L. W. Evans

[57] ABSTRACT

A mechanical actuator operated by electrical power suitable for actuating down hole equipment in a well, e.g. down hole safety valves, has an electric motor, a gear assembly with a mechanical advantage of at least 30:1, a two-part drive sleeve, the parts being connected by, e.g. splines so that the two parts can rotate together while capable of relative axial movement, an actuating sleeve moved axially by rotation of the drive sleeve, and a releasable lock operated by a solenoid to lock the two parts of the drive sleeve against relative axial movement. Rotation of the motor in one direction primes the actuator, rotating in the other direction actuates the equipment and the solenoid-operated releasable lock holds the equipment in the actuating position. If the solenoid is switched off, deliberately or by power failure, the lock is released allowing the equipment to return to its fail-safe position.

11 Claims, 3 Drawing Sheets

DOWN HOLE ELECTRICALLY OPERATED SAFETY VALVE

Figure 1:
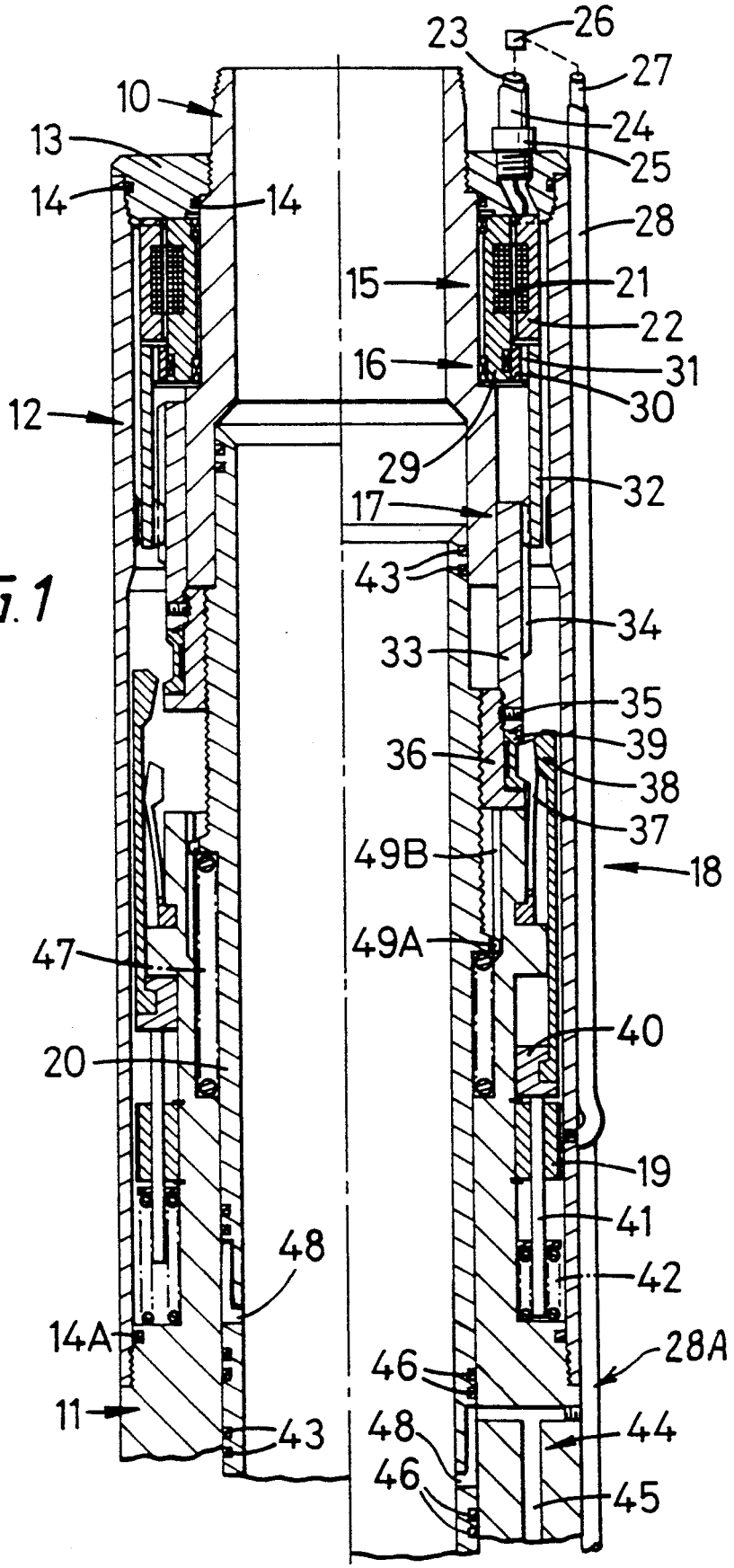

This invention relates to a down hole safety valve suitable for use in wells used, directly or indirectly, for oil and/or gas production.

Wells used directly for oil or gas production deliver the oil or gas up tubing hung inside a cased hole. Production can be assisted by pumping gas into the annulus surrounding the production tubing and passing it through gas lift mandrels into the production tubing. Wells used indirectly for oil or gas production may inject water into the reservoir below the oil layer or pump excess gas back into the reservoir above the oil layer.

The pressure in either type of well may be considerable so the well has to be isolated by a well tree placed on the well head with valves to control the flow of fluids from or into the well. Well heads can be situated on land, on fixed or floating off shore platforms, or on the sen bed itself. These positions are vulnerable to external forces (fire, explosion, collision, snagging) which could damage the well head or well tree below the isolation valves or damage the valves themselves. This could open up the well with possible catastrophic results.

To prevent such an occurrence, self-closing valves may be placed down the well, both in :he production tubing and the annulus. They may be surface controlled sub-surface safety valves (SCSSV) or down hole safety valves (DHSV). The valves have springs so that they fail safe closed in an emergency and are kept open by hydraulic fluid pressure supplied through a relatively small bore tube. The use of hydraulic fluid pressure to operate the valves has a number of disadvantages:

1. Hydraulic friction in a small bore tube and the temperature factor limits the effective depth of operation.

2. The longer the length of small bore tubing the more vulnerable the lines and the longer it takes to vent down when the valve closes.

3. Directly controlled DHSVs have to force the hydraulic fluid back up the line when they fail safe closed. This reduces the speed of closure and requires the valves to have large bulky springs.

These three disadvantages prevent the DHSV being set deep down in the well.

Another disadvantage of hydraulically operated DHSVs is that the hydraulic lines have to pass through the well head or tree. Each fluid path below the valves of the tree is a potential leak path out of the well. Any failure of the DHSV seals or of the control line will result in the well pressure being exerted directly onto the hydraulic fluid exit ports and on to the control system. Extra tree fail safe valves must therefore be incorporated on each down hole control line.

Two types of hydraulic control systems can be used to operate the DHSV. These are:

DIRECT CONTROL

One direct line is used to operate the valve, which means that the hydraulic pressure must exceed the maximum well pressure to open the valve. This has the disadvantage that a high pressure line is required.

PRESSURE BALANCED CONTROL

To eliminate the need for a high pressure line a balanced line can be used which relieves the pressure behind the operating piston in the DHSV. This has the disadvantage that two lines are required per DHSV, thus doubling the number of lines susceptible to collapse pressure from the well.

The above-mentioned disadvantage of hydraulic operation of DHSVs can be eliminated by controlling the valves electrically. There are two aspects of electrical operation of down hole equipment, viz.

the functional operation of the equipment, e.g. the valve, and the means for supplying the electrical power both to operate the equipment and to supply operating instructions.

The advantages of electric power in functional operation are:

1. Action is direct and quick with no time delay in responding. The amount of current used can be measured, giving a good indication of whether the function is operating properly.

2. Current can be reversed, so that a system can be driven in both directions in a controlled manner.

3. The use of electricity is relatively independent of distance and temperature. Thus DHSVs can be set deep down the hole thereby increasing well safety.

4. Once the electricity has been switched off, or if it fails, there are no residual forces remaining. Thus a fail safe closed valve will close faster, increasing the safety response to any malfunctions in the well.

The advantages of electric power as regards supply are:

1. Pressure sealed electric cable can be used through the well head and well tree into the well bore. There is no need for any fluid path below the well tree master valves.

2. The electric cables and insulation can be housed in stainless steel tubing which is less susceptible to crushing or crimping.

The present invention is concerned with a mechanical actuator operated by electrical power suitable for actuating down hole equipment in a well, for example a down hole safety valve.

Accordingly the present invention comprises an electric motor, said motor driving a gear assembly having a drive gear and operating gear, said assembly being designed to give a mechanical advantage of at least 30:1 between the drive fear and operating gear, the latter engaging with a two-part drive sleeve, the parts being connected so that the two parts rotate together but are capable of relative axial movement, said drive sleeve engaging with an actuating sleeve for actuating the down hole equipment, and a releasable lock operated by a solenoid to lock the two-part drive sleeve against relative axial movement.

The electric motor is preferably a DC motor, but an AC motor could be used.

UK Patent Application No 221625A describes and claims a mechanical actuator for moving a shaft axially comprising:

a motor and a source of power for the motor, said motor driving, a gear assembly comprising a drive gear, a reaction gear and an operating gear, the drive gear, reaction gear and operating gear cooperating to give a mechanical advantage of at least 30:1 between the drive gear and operating gear, said operating gear engaging with an internally screw threaded sleeve engaging with an external screw thread on the shaft so that rotation of the sleeve moves the shaft axially relative to the sleeve, and, a stop connected to the reaction gear preventing axial movement of the sleeve.

The actuator of GB 2216625A may be powered by a DC or AC electric motor and may be used for example for sub-sea valves of a sub-sea oil or gas production complex. The present invention may be considered as a development of the actuator of GB 2216625A designed specifically for actuating down-hole equipment.

The actuator of GB 2216625A and the present actuator may need to be primed to bring them to or restore them to their actuating positions, i.e. the rotatable sleeves may have to be capable of being rotated in both directions by the electric motor. The motor is thus preferably reversible and may conveniently be a DC Motor.

The gear assembly giving a mechanical advantage of at least 30:1 may be similar to that described in GB 2216625A. Thus it may be a form of differential with a drive gear, reaction gear, and operating gear with the drive gear being eccentrically mounted with respect to its drive shaft and the reaction gear and having one or two fewer teeth so that one full rotation of the drive gear moves the drive and reaction gears only one or two teeth relative to each other. The operating gear is connected to the drive gear so that it, too, rotates by only one or two teeth for each full rotation of the drive shaft, thereby giving the high mechanical advantage required.

Another related form of gear assembly is a flexible transmission such as that produced by Harmonic Drive Ltd having a wave generator operated by the DC motor acting on a flexible elliptical band, the flexible band contacting a circular splined wheel at two points. The flexible splined band precesses within the circular wheel in the same way as the internal gear wheel of the more conventional differential.

The mechanical advantage of the gear assembly may be considerable, e.g. 50-150:1, thereby allowing a relatively low power motor, e.g. a 24 volt motor, to actuate down hole equipment against a strong fail safe spring of the equipment.

In the gear assembly of the present invention the reaction gear or circular splined wheel is fixed so that the transmission is from the drive gear to the operating gear with the required mechanical advantage.

The two-parts of the two part drive sleeve may be connected by splines to allow the two parts to rotate together while being capable of relative axial movement.

The end of the two-part drive sleeve farthest from the gear assembly may be screw-threaded and engage with screw threads of the actuating sleeve, so that rotation of the drive sleeve moves the actuating sleeve axially up or down the screw threads and hence moves the equipment, e.g. opens a down-hole safety valve against the force of its fail safe spring tending to keep it closed.

The releasable lock operated by a solenoid to lock the two-part sleeve against relative axial movement may be a collet engaging with a groove in the end of the two-part drive sleeve farthest from the gear assembly, e.g. adjacent the point where its screw thread engages with the screw thread of the actuating sleeve. The groove may be in a bearing bushing so that the drive sleeve can rotate while the collet and groove do not. The solenoid will thus hold the two part sleeve and actuating sleeve against axial movement, a relatively small current being capable of effecting this. Any failure of the electrical power supply or any deliberate switching off the power supply will release the lock thereby allowing the fail safe spring of the down hole equipment to act closing the equipment and moving the actuating sleeve and the actuation sleeve - disengaging part of the two-part drive sleeve axially.

The down hole equipment to be actuated may be any required piece of equipment, but may particularly be a down-hole safety valve. It may be a DHSV for the production tubing or for the annulus. It may thus be used in combination with an annulus down hole safety valve as described in UK Patent Application No 9017916.9.

The valve and actuating sleeve may have flow equalising ports and passages allowing the down hole pressures on either side of the valve to balance prior to the opening of the valve, thereby reducing the actuating force required to open the valve.

Figure 2:
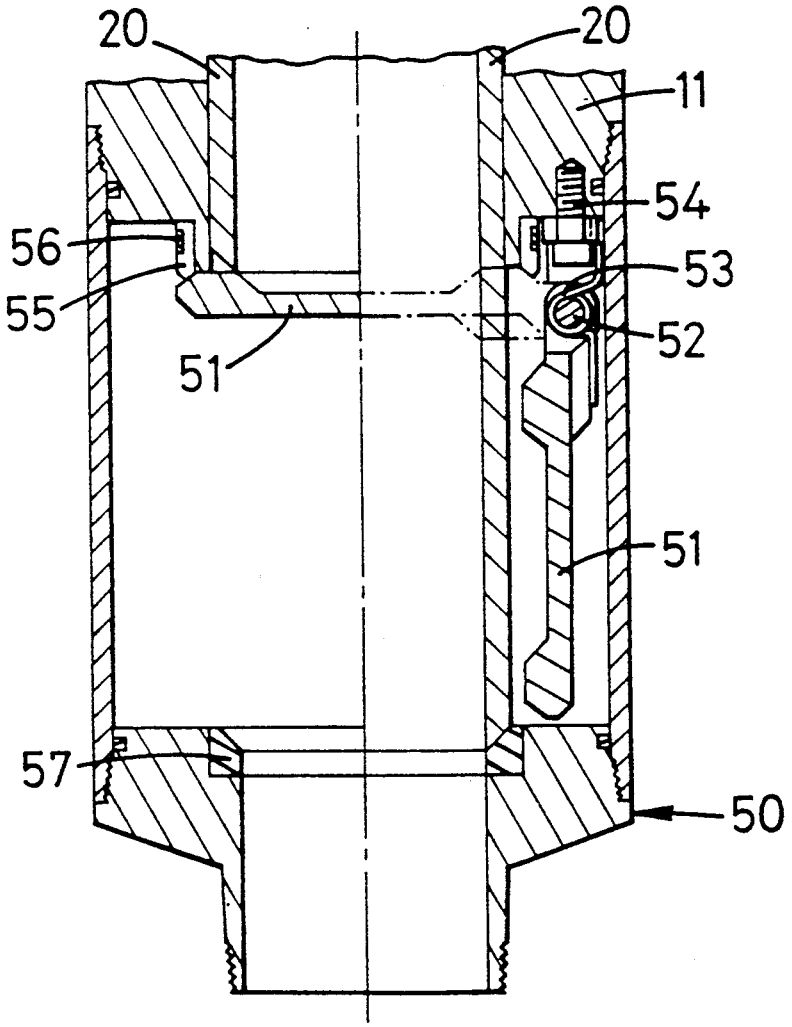
Figure 3:
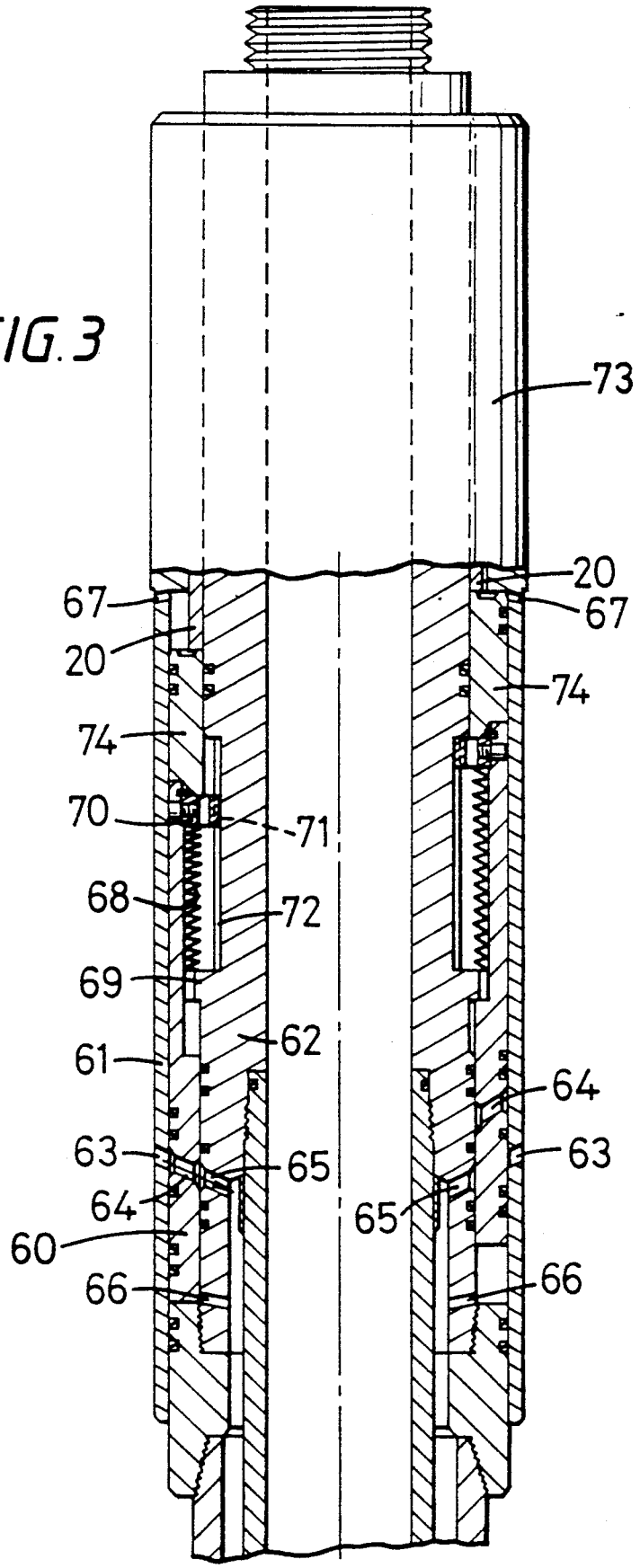

The invention is illustrated with reference to the accompanying drawings in which FIG. 1 is a section through a mechanical actuator and DC motor according to the present invention, FIG. 2 is a section through a production tubing down hole safety valve suitable for operation by the actuator of FIG. 1, and FIG. 3 is section through an annulus down hole safety valve suitable for operation by the actuator of FIG. 1.

The left hand side of FIG. 1 shows the actuator of the present invention in its non-operational position and with the valve to be actuated closed. The right hand side of FIG. 1 shows the actuator operational, holding the valve open. This is for purposes of illustration only, it being understood that the drive sleeve and actuating sleeve of the actuator are cylinders.

In FIG. 1, upper mandrel 10 and lower mandrel 11 are inserted into the production tubing of a well just above the down hole equipment to be actuated. Surrounding and spaced from the mandrels is valve housing 12 enclosing an annular space between it and the mandrels. The annular space is closed at the top by plate 13 screw threaded onto upper mandrel 10 and valve housing 12 and having seals 14 to prevent fluid ingress into the annular space. The annular space is sealed at the bottom by valve housing 12 being screw threaded onto lower mandrel 11 and by seal 14A.

Within the annular space is a DC motor and mechanical actuator assembly. This assembly is formed, reading from the top downwards, of a brushless 24 V DC electric motor 15, harmonic drive gear 16, two-part drive sleeve 17, collet lock assembly 18 and solenoid 19. Actuating sleeve 20 is within the upper and lower mandrels 10, 11 spanning the gap between the mandrels. It has splines 49A engaging with splines 49B on lower mandrel 11.

Describing these main parts of the assembly in more detail, electric motor 15 may be of standard known design with armature or rotor 21 and stator or field-windings 22. Electrical power is supplied through pressure sealed cable 23 enclosed in steel tubing 24 with a screw threaded connector 25 where the cable passes through top plate 13. There is a junction box 26 in cable 23, splitting the power supply so that it goes both to motor 15 and solenoid 19. The power supply to solenoid 19 has its own pressure sealed cable 27 within steel tubing 28 passing down the outside of valve housing 12. A parallel line 28A for downhole gauges is run alongside the valve line 28.

Electric motor 15 drives harmonic drive gear 16, which may also be of known type and construction having a wave generator 29 driven by the motor, acting on a flexible splined band 30 within a circular spline 31. As previously explained the flexible band 30 engages with circular spline 31 at two points and rotation of the wave generator 29 will precess the two contact points around circular spline 31. A circular gear with 202 splines and a flexible band with 200 splines will move circular spline 31 two splines per rotation of wave generator 29, giving the gear assembly a mechanical advantage of 100:1.

Circular spline 31 engages with the top end of two-part drive sleeve 17. The top part of the sleeve is indicated at 32, and the bottom part at 33, the two parts being connected by splines 34. Rotation of circular spline 31 will thus rotate both parts of the two part sleeve 17 while allowing axial movement between the parts.

Bottom part 33 has attached to it an externally and internally screw threaded extension 36. The external screw threads attach it to bottom part 33, with screws 35 locking the two parts together. The internal screw threads engage with screw threads of actuating sleeve 20. The length of screw thread on actuating sleeve 20 is longer than that of extension 36.

Collet lock assembly 18 has two collets, finger collet 37 and lock collet 38. Finger collet 37 is fixed at its bottom end into lower mandrel 11 and is biased outwardly. It can, however, be pushed into a recess of bearing bushing 39, which forms part of extension 36 of bottom part 33 of two part sleeve 17. Bushing 39 has bearing faces so that it will stay stationary when two-part sleeve 17 rotates.

Lock collet 38 is fixed into a split base ring 40 which has rod 41 passing through solenoid 19. Spring 42 surrounds the bottom of rod 41. Spring 42 tends to force rod 41, base ring 40 and lock collet 38 upwardly (see left hand side of drawing) so that lock collet 38 is above the level of finger collet 37. However, if solenoid 19 is energised in the right direction by DC current it will pull the assembly down against spring 42 so that lock collet 38 bears on finger collet 37 forcing it into the recess of bushing 39 (see right hand side of drawing).

It will be appreciated that there may be a number of lock assemblies 18 spaced around the essentially annular actuator.

Actuating sleeve 20 has seals 43 sealing it with respect to upper mandrel 10 and lower mandrel 11. These may be double seals, i.e. with one decompression resistant seal and one chemically resistant seal. Actuating sleeve 20 and lower mandrel 11 have a flow equalising system 44 of ports and passages, i.e. port 48 in sleeve 20 and passage 45 in lower mandrel 11, extending down to the down hole side of the valve to be actuated. Port 48 in actuating sleeve 20 is protected by double seals 46. Actuating sleeve 20 has springs 47 between it and lower mandrel 11, these springs tending to force the sleeve to its upper position.

The actuator may be assembled as shown on the left hand side with actuating sleeve 20 and part 33 of two port sleeve 17 in their upper positions. The valve to be actuated will be closed.

Bearing bushing 39 is well above finger collet 37. The first action of a valve opening sequence is to prime the actuator by passing DC current in one direction. Motor 15 is operated in a direction of rotation that moves two part sleeve part 33 and extension 36 down the screw threads of actuating sleeve 20 to the bottom of these threads. This position is not shown in FIG. 1 but the action will take extension 36 and bearing bushing 39 down to a level where the bearing bushing recess is opposite the top of finger collet 37. The DC current will also be going to the solenoid and with this direction of current, will assist spring 42 in keeping lock collet 38 in its up position. No other parts move and finger collet 37 will not enter the recess. The downward movement of extension 36 and bearing bushing 39 is limited by the top of lower mandrel 11. Rotation of the DC motor in this direction is then stopped.

To open the valve, a reverse DC current is sent to motor 15 and solenoid 19 pulls down lock collet 38 against spring 42 forcing finger collet 37 into the recess of bearing bushing 39. This locks the relevant parts. The solenoid remains energised and the motor 15 is now operated in the opposite direction of rotation to that of the priming. Bearing bushing 39 remains stationary holding the lock but extension 36 rotates forcing actuating sleeve 20 down the screw threads. Actuating sleeve 20 is prevented from rotating by its splines 49A engaging with the splines 49B of lower mandrel 11.

The first part of the travel of actuating sleeve 20 will bring its flow equalising port 48 into alignment with the passage 45 in lower mandrel 11. The actuating sleeve will have reached the valve but the differential pressure across the valve may cause the motor to stall. Once the pressure has equalised across the valve through the pressure equalising ports and passages the actuator will have sufficient power to push down on the valve so that further rotation of motor 15 moves actuating sleeve 20 down to open the valve. When the valve is fully open, extension 36 will be at the top of the screw threads of actuating sleeve 20 and the motor will stall.

Power supply is maintained to the solenoid 19 and so long as it remains energised then the valve will remain open with lock collet 38 holding finger collet 37 into its recess. This open valve position is that shown on the right hand side of FIG. 1.

Any deliberate or accidental shut off of power to the solenoid 19 will allow spring 42 to move lock collet 38 up releasing the lock. Spring 47 of actuating sleeve 20 will then move actuating sleeve 20, extension 36 and part 33 of two part sleeve 17 up, allowing the fail safe spring of the valve to operate and close the valve (i.e. the parts will be restored to the position shown on the left hand side of FIG. 1).

When the cause of the system shut-down has been determined and corrected the valve may be opened again when desired.

While the power required to rotate two part sleeve 17 and move actuator sleeve 20 may be fairly high, only relatively low power is required to keep solenoid 19 energised and hold the valve open. The current being supplied to both the motor and the solenoid can be monitored. Any variation in current required may be a sign of an incipient malfunction or a change in down hole conditions allowing preventative remedial action to be taken.

FIG. 2 is a section through a conventional production tubing down hole safety valve which can be actuated electrically using the actuator of FIG. 1. The figure is illustrative, since the left hand side shows the valve shut and the right hand side open.

FIG. 2 shows a tubing sub 50 inserted into production tubing just below the actuator of FIG. 1. Actuating sleeve 20 of FIG. 1 extends down within the tubing 50. The valve is a flapper valve of known construction having flapper 51 mounted on hinge 52 and having a powerful spring 53 tending to move it to the closed horizontal position. Hinge 52 and spring 53 are to one side of the valve body being fixed to the lower mandrel 11 by screw 54. Tubing sub 50 has an upper valve seat 55 held by retainer ring 56 and a lower stop 57 made of elastomeric material.

When the valve is closed (see left hand side of drawing) flapper 51 is forced onto seat 55 by spring 53. However, if actuating sleeve 20 is moved down as described with reference to FIG. 1 then flapper 51 is gradually pushed through 90° to the position shown on the right hand side of the drawing. The downward movement of actuating sleeve 20 is limited by elastomeric stop 57. If actuating sleeve 20 is released as described with reference to FIG. 1 it moves back up quickly allowing spring 53 to close the valve equally rapidly.

FIG. 3 is a section through an annulus down hole safty valve which can be actuated electrically using the actuator of FIG. 1.

The valve itself is of the type described in UK Patent Application No 9017916.9. Hydraulic operation of the valve is specifically described in these two applications but no changes in construction or operation of the valve itself are necessary to adapt it for electrical actuation.

FIG. 3 is, again, illustrative, showing on the left hand side, the valve in the open position and, on the right hand side, the valve in the closed position.

Full details of the construction and operation of the valve are given in the above mentioned patent application. Briefly, for the purposes of the present application, the valve surrounds an insert into the well production tubing and comprises a slide valve 60 capable of sliding between inner and outer sleeves 61 and 62. As shown on the left hand side of the drawing, when the valve is open, slide valve 60 is at the bottom of its travel so that port 63 in outer sleeve 61, passage 64 in slide valve 60 and port 65 in inner sleeve 62 are aligned, allowing fluid to pass up or down the annulus.

The fluid pressure in the annulus below the valve is accessible to the bottom of slide valve 60 via port 66 in inner sleeve 62, and the fluid pressure in the annulus above the valve is accessible to the top of slide valve 60 via port 67 in outer sleeve 61.

The other force acting on slide valve 60 are springs 68 between a projection 69 on inner sleeve 62 and a split stop ring 70 retained on the top of slide valve 60. Stop ring 70 also acts as an anti-rotation ring for slide valve 60 since it has keys 71 sliding in slots 72 of inner sleeve 62.

The position of slide valve 60 in normal operation, and hence whether the valve is open or closed, thus depends on the relative fluid pressure in the annulus above and below the valve and the power of spring 68. Spring 68 tends to move slide valve 60 to its upper closed position (see right hand side of drawing) but the valve can be opened against this spring force if the annulus fluid pressure above the valve is greater than the annulus fluid pressure below the valve.

However, if required, the valve can be held open by secondary means, viz an actuator as described in FIG. 1 positioned above the valve in the general position indicated at 73 in FIG. 3. Actuating sleeve 20 of the actuator bears on a secondary sleeve 74 between inner and outer sleeves 61, 62, this secondary sleeve, in its turn, bearing on the top of slide valve 60 and its stop ring 70.

For the normal closed position, the sleeve 74 is at the top of its travel (see right hand side of drawing) with actuator 73 not in operation and hence with actuating sleeve 20 also in its upper position. The actuator 73, actuating sleeve 20, and secondary sleeve 74 do not, therefore, interfere with the closed operation of the valve which positions itself according to the forces of spring 68 and the relative annulus fluid pressures above and below the valve.

Nevertheless, if actuator 73 is energised and actuating sleeve 20 is moved down as described with reference to FIG. 1, secondary sleeve 74 will also move down and force slide valve 60 to its bottom open position as shown on the left hand side of FIG. 1.

While the invention has been described in this specification in relation to down hole safety valves which fail safe closed, it could be used for actuating any down hole equipment, including equipment or valves which fail safe open.

I claim:

1. A mechanical actuator operated by electrical power, suitable for actuating down hole equipment in a well comprising an electric motor, said motor driving a gear assembly having a drive gear and operating gear, said assembly being designed to give a mechanical advantage of at least 30:1 between the drive gear and operating gear, the later engaging with a drive sleeve, formed in two parts, said two parts being connected so that they rotate together but are capable of relative axial movement, one end of one part engaging with the gear assembly and the other end of the other part furthest from the gear assembly engaging with an actuating sleeve for actuating the down hole equipment, and a releasable lock operated by a solenoid to lock the two-part drive sleeve against relative axial movement.

2. A mechanical actuator as claimed in claim 1 wherein the electric motor is a reversible motor.

3. A mechanical actuator as claimed in claim 1 wherein the electric motor is a DC motor.

4. A mechanical actuator as claimed in claim 1 wherein the gear assembly is a differential with a drive gear, reaction gear and operating gear.

5. A mechanical actuator as claimed in claim 4, wherein the gear assembly is a flexible transmission, the drive gear, reaction gear and operating gear being formed of a wave generator, flexible elliptical band and circular splined wheel.

6. A mechanical actuator as claimed in claim 1 wherein the mechanical advantage of the gear assembly is from 50 to 150:1.

7. A mechanical actuator as claimed in claim 1 wherein the two parts of the two-part drive sleeve are connected by splines to allow the two parts to rotate together while being capable of relative axial movement.

8. A mechanical actuator as claimed in claim 1 wherein said other end of said other part of the drive sleeve farthest from the gear assembly and the actuating sleeve are screw-threaded, said screw threads engaging so that rotation of the drive sleeve moves the actuating sleeve axially.

9. A mechanical actuator as claimed in claim 1 wherein the releasable lock operated by a solenoid is a collet engaging with a groove in the end of the two-part drive sleeve farthest from the gear assembly.

10. A mechanical actuator as claimed in claim 9 wherein the groove is in a bearing bushing so that the drive sleeve can rotate while the groove and collet cannot.

11. A mechanical actuator as claimed in claim 1 wherein the down hole equipment to be actuated is a down hole safety valve.

* * * * *